United States Patent [19]

Katayama et al.

[11] 4,410,360

[45] Oct. 18, 1983

[54] PROCESS FOR PRODUCING HIGH CHROMIUM STEEL

[75] Inventors: Hiroyuki Katayama; Hidetake Ishikawa; Chikara Saito; Hirofumi Wakimoto, all of Fukuoka, Japan

[73] Assignee: Nippon Steel Corporation, Tokyo, Japan

[21] Appl. No.: 211,719

[22] Filed: Dec. 1, 1980

[30] Foreign Application Priority Data

Dec. 1, 1979 [JP] Japan ..... 54/154990

[51] Int. Cl.[3] ..... C22C 33/00

[52] U.S. Cl. ..... 75/60; 75/130.5

[58] Field of Search ..... 75/60, 130.5

[56] References Cited

U.S. PATENT DOCUMENTS

| | | | |
|---|---|---|---|
| 3,158,464 | 11/1964 | Chynow et al. | 75/130.5 |
| 3,396,014 | 8/1968 | Keyser | 75/130.5 |
| 3,816,100 | 6/1974 | Ramachandran | 75/130.5 |

*Primary Examiner*—P. D. Rosenberg

*Attorney, Agent, or Firm*—Wenderoth, Lind & Ponack

[57] ABSTRACT

A process for producing high chromium steel is disclosed which comprises supplying molten iron in a smelting furnace with a solid chromium source, carbonaceous powder and oxygen-containing gas in amounts so controlled as to keep the melt at a temperature in the range of less than 1650° C. and above the minimum melt temperature at the specific carbon and chromium levels in the melt and which is capable of performing preferential decarbonization while inhibiting the oxidation of chromium.

15 Claims, 10 Drawing Figures

PROCESS FOR PRODUCING HIGH CHROMIUM STEEL

BACKGROUND OF THE INVENTION

1. Field of the Invention

This invention relates to an economical process for producing medium carbon, high chromium molten iron which is obtained as an intermediate in the production of high chrome steels such as stainless steel and heat resisting steel.

2. Description of the Prior Art

Following the recent development and commercial operation of second refining processes such as the vacuum oxygen decarbonization (VOD) method and argon oxygen decarbonization (AOD) method that rely on preferential decarbonization, steel makers are taking more interest in the production of high chromium crude melt to lower the cost of producing stainless steel.

Japanese Patent Publication No. 4486/77, entitled "Process for producing stainless steel", invented by Toyosuke Tanoue et al. and filed by Sumitomo Metal Industry Co., Ltd. describes a process for producing stainless steel using high carbon ferrochrome as a chromium source. This prior invention uses a chromium source composed of high carbon chromium in a hot molten state and it essentially differs from the process of the present invention which starts with using solid high carbon ferrochrome at ordinary temperature as a chromium source. The reasons are:

(1) It is not economically feasible to obtain hot materials at a stainless steel mill, so it is generally difficult for the process of the prior invention to obtain high carbon ferrochrome in a molten state;

(2) Therefore, to perform that process, it is generally necessary to use solid high carbon ferrochrome at ordinary temperature, which is then heated in an electric furnace to a temperature higher than its melting point to form high carbon ferrochrome in a molten state.

The present invention manipulates the carbon and chromium contents (in wt%) in the molten iron so as to dissolve solid high carbon ferrochrome in the melt at a temperature lower than its melting point (i.e. without being heated to that point). Hence, the concept of the present invention differs entirely from that of the prior invention. The course followed by the Sumitomo process is Route I as depicted in FIG. 10 of the accompanying drawings. Route II in that figure represents the melting of solid high carbon ferrochrome to provide molten, high carbon ferrochrome. The route taken by the present process is not II→I but III which indicates that solid high carbon ferrochrome is taken into solution by the melt at a temperature lower than the melting point of the ferrochrome.

Japanese Patent Application (OPI) No. 108116/75 (the term "OPI" as used herein means a Japanese unexamined published patent application), entitled "Process for producing low carbon chromium steel and ferrochrome alloy", aims at producing high-grade chromium steel of low carbon content (less than 0.05%) by refining high carbon chrome-bearing molten metal with oxygen without having the difficulties encountered in the known methods, i.e. formation of slag that contains an undesired amount of chromium and attack of the refractory lining of the refining vessel. To reduce the chromium content in the slag, such invention locates one or more nozzles around each oxygen injecting nozzle through which to supply a solid carbon carrier in dust form below the surface of the molten metal bath so that the oxygen jet is shrouded by a jacket of the fine particulate carbon carrier. In this prior art process, carbon is supplied to prevent oxidation of chrome. In this process, if an oxygen jet is supplied directly to the molten metal to produce high-grade chromium steel of a carbon content lower than 0.05%, oxidation of chromium occurs, and to prevent this, the process supplies a jacket of fine particulate carbon carrier that shrouds the oxygen jet.

In the present process, carbon is not used to prevent oxidation of chromium, but rather is supplied as a heat source to dissolve a solid chromium source such as high carbon ferrochrome at low temperatures in the medium carbon melt in a smelting furnace. The melt produced by the present process contains a medium amount of carbon. When a carbon source is supplied to the furnace from below in the present process, it is supplied through a basal tuyere of triple concentric tube type composed of an inner tube for supply of carbon, an intermediate tube for supply of oxygen and an outer tube for supply of a coolant. Hence, the present process contemplates an intermediate having a different carbon level than that of the product contemplated by the prior art process, and since carbon is blown for different purposes in the two processes, the construction of the basal tuyere used also differs between the two processes. Therefore, the process of Japanese Patent Application (OPI) No. 108116/75 differs from the present process in object, construction and effect.

A third prior art reference is Japanese Patent Application (OPI) No. 10319/78, entitled "Metal refining method and apparatus", filed by British Steel Corporation. It describes an invention which relates to the manufacture of steel and in particular relates to a method and apparatus whereby solid iron-bearing materials can be converted to molten steel in a continuous, semi-continuous or batch mode. According to one aspect of such invention, there is provided, in a method of manufacturing steel in a metallurgical vessel containing molten ferrous metal, a process for raising the energy level within the melt comprising injecting solid carbonaceous material below the surface of the melt and introducing oxygen or an oxygen-containing gas into the vessel to react with the carbonaceous material to liberate heat. Such invention utilizes carbon to generate heat but it does not contemplate chromium-containing steel at all as a product. In contrast, the present invention contemplates high chromium crude molten iron as an intermediate product, and to manufacture it at low cost, the present invention uses the heat generated by using carbon according to the content (in wt%) of carbon and chromium in the molten steel. Therefore, the two inventions may be the same as each other in that both utilize carbon as a heat source, but they differ from each other in object, construction and effect.

SUMMARY OF THE INVENTION

The primary purpose of this invention is to provide an economical process for producing high chromium crude melt which is obtained as an intermediate in the production of high chrome steels such as stainless steel. This purpose is achieved by the following methods of this invention.

1. A process for producing high chromium steel which comprises supplying molten iron in a smelting furnace with a solid chromium source, carbonaceous powder and oxygen-containing gas in amounts so controlled as to keep the melt at a temperature in the range of less than 1650° C. and above the minimum melt temperature at the specific carbon and chromium levels in the melt and which is capable of performing preferential decarbonization while inhibiting the oxidation of chromium. The term "solid chromium source" as used hereinabove means a source that is composed of one or more substances selected from the group consisting of high carbon ferrochrome, medium carbon ferrochrome, low carbon ferrochrome, metallic chromium, chrome ore, partially reduced chromium pellets and chromium-bearing scrap and which contains unmelted chromium.

2. A process according to Paragraph 1 wherein the temperature above the minimum melt temperature is defined by the following formulae (2), (3), (4) and (5):

$$\text{Melt temp. (°C.)} \geqq 17.5\frac{[Cr]}{[C]} + 1200 \quad (2)$$

$$\text{Melt temp. (°C.)} \geqq -140\,[C\,(\%)] + 1650 \quad (3)$$

$$\text{Melt temp. (°C.)} \geqq 110\,[C\,(\%)] + 1050 \quad (4)$$

$$\text{Melt temp. (°C.)} \geqq -273 + \frac{15673}{8.84 + \log\frac{8.3 - [C\,(\%)]}{4.0}} \quad (5)$$

3. A process according to Paragraph 1 wherein the formula (3) is replaced by the formula (13):

$$\text{Melt temp. (°C.)} \geqq -140[C(\%)] + 1710 \quad (13)$$

4. A process according to Paragraph 1 wherein the melt temperature is held below 1580° C.

5. A process according to Paragraph 1 wherein the refining of the melt in a smelting furnace is achieved by dissolving in the melt a carbonaceous powder and oxygen-containing gas supplied through tuyeres located in the lower part of the furnace.

6. A process according to Paragraph 5 wherein the tuyeres are of triple concentric tube type composed of a central passageway through which to blow a carrier gas and a carbonaceous powder, an intermediate annular passageway through which to blow an oxygen-containing gas and an outer annular passageway through which to blow a coolant for the tuyeres.

7. A process according to Paragraph 1 wherein the refining of the melt in a smelting furnace is achieved by dissolving in the melt carbonaceous lumps supplied from above the furnace.

8. A process according to Paragraph 1 wherein the refining of the melt in a smelting furnace is achieved by dissolving in the melt a carbonaceous powder and an oxygen-containing gas supplied through a top blowing lance located on top of the furnace.

9. A process according to Paragraph 1 wherein the solid chromium source is supplied to the melt in a smelting furnace in divided portions.

10. A process according to Paragraph 1 wherein the oxygen-containing gas is supplied through a top blowing lance and tuyeres located in the lower part of the furnace.

11. A process according to Paragraph 1 wherein the carbonaceous powder is partially replaced by a solid carbonaceous powder comprising carbonaceous particles to which metallic nickel adheres.

12. A process according to Paragraph 1 wherein the melt is further supplied with nickel oxide that has been pre-reduced outside the smelting furnace.

13. A process according to Paragraph 1 wherein the shape of the smelting furnace is such that the following formula (11) is satisfied:

$$\left.\begin{aligned} S_1 \geqq S_2 \geqq 1.2\frac{Wi}{Wf}S_1 \\ 1.2\frac{Wi}{Wf}S_1 \geqq S_3 \geqq 0.8\frac{Wi}{Wf}S_1 \end{aligned}\right\} \quad (11)$$

wherein $S_1$ ($m^2$) is the average cross-sectional area of the topmost part (H/3) of the final melt whose height is H (m) in terms of the still melt level, $S_2$ ($m^2$) is the average cross-sectional area of the middle part (H/3), $S_3$ ($m^2$) is the average cross-sectional area of the lowest part (H/3), Wi (ton) is the quantity of the initial melt, and Wf (ton) is the predetermined quantity of the final melt.

14. A process for producing low carbon, high chromium steel by performing further decarbonization of the medium carbon, high chromium melt obtained by the process of Paragraph 1.

15. A process for producing low carbon, high chromium steel by controlling the chromium content of the medium carbon, high chromium melt obtained by the process of Paragraph 1 by adding molten steel which does not contain chromium, followed by decarbonization of the so controlled melt.

BRIEF DESCRIPTION OF THE DRAWINGS

In FIG. 10, curve A shows schematically the liquidus temperature of ferrochrome.

DETAILED DESCRIPTION OF THE INVENTION

Figure 1:
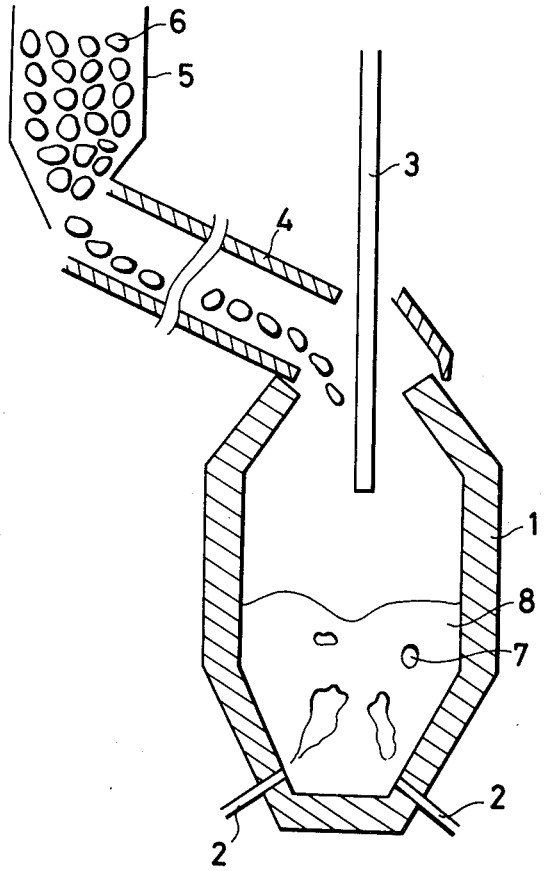
FIG. 1 is a schematic representation of the general view of an apparatus for performing the process of the present invention.

Our invention relates to an economical process for producing medium carbon, high chromium molten iron which is obtained as an intermediate in the production of high chromium steels such as stainless steel. The term "medium carbon high chromium molten iron" as used herein refers to iron which contains at least 12% of chromium when it is obtained as an intermediate for the manufacture of stainless steel and at least 4% of chromium when it is obtained as an intermediate for the manufacture of other types of high chromium steel. The upper limit of the chromium level is determined by the amount of high carbon ferrochrome used as a chromium supply and is generally less than 65%. The carbon level depends on the chromium level and the term "medium carbon" has the conventional meaning and is defined by the saturated carbon (%)×(0.05 to 0.6). Stated more specifically, the medium carbon, high chromium molten iron as contemplated by the invention has a chromium level of 4 to 65 wt% and its Cr(%)/C(%) ratio is within the range of from 8 to 30. The process of the invention is hereunder described as if it were used to produce medium carbon, high chromium molten iron that is obtained as an intermediate in the manufacture of stainless steel, but it should be understood that the following description applies without substantial change to the case where the process is used to produce medium carbon, high chromium molten iron that is obtained as an intermediate in the manufacture of other types of high chromium steel.

Stainless steel is mainly composed of Fe-Cr and Fe-Cr-Ni. Normally, ferrochrome and stainless steel scrap are chromium sources, solid iron (e.g. scrap and reduced iron) and iron in a molten state (i.e. molten pig iron or steel) are iron sources, and stainless scrap, ferronickel, metallic nickel and NiO are nickel sources. To make stainless steel from these sources, they are melted, mixed and subjected to primary refining in the steel making furnace to form high chromium crude melt (containing more impurities like carbon than the stainless steel product) which is then subjected to secondary refining.

This invention is the result of experimental studies to provide an economical method of producing high chromium crude melt that satisfies the requirements mentioned below, to thereby achieve economical manufacture of stainless steel and other high chromium steels.

The following are some of the requirements for producing high chromium crude melt at low cost:

(1) Inexpensive materials must be available. Typical chromium sources are solid high carbon ferrochrome, melted high carbon ferrochrome, medium carbon ferrochrome, low carbon ferrochrome and stainless steel scrap. Medium carbon and low carbon ferrochromes which are used as alloying components are produced by treating high carbon ferrochrome, so in the state of the art, it is very uneconomical to use them as primary chromium sources. If there is a ferrochrome plant located close to the steel making furnace, melted high carbon ferrochrome can be supplied directly to the steel making furnace in the form of ferrochrome from the electric furnace in the ferrochrome plant. But this is ordinarily difficult unless the ferrochrome is remelted before it is supplied to the steel making furnace. Therefore, the practical and inexpensive primary chromium source is solid high carbon ferrochrome, and the method of its melting and decarbonization is an important factor for the manufacture of stainless steel.

For a steel plant that produces not only stainless steel but also plain carbon steel, it is economical to use molten pig iron or steel rather than solid iron as an iron source because this requires less energy for preparing the iron source.

Most steel plants can use nickel sources only in solid state and which nickel source is the most economical depends on the economical requirements of each plant. Therefore, the steel making furnace must use plain iron sources in a molten state and a great amount of solid materials for alloying, from the stand points of economy of raw materials. But at the same time, these materials must achieve efficient supply of the energy for melting as well as efficient primary refining for satisfying the conditions that are required for the composition of the crude melt by the secondary refining furnace.

(2) High heat efficiency must be achieved if inexpensive energy is used. There are several methods to supply the energy for melting. For example, an electric furnace is capable of melting a charge having any solid content. But for one thing, electricity is an expensive form of energy, and for another melting in the electric furnace (particularly an arc furnace) is performed under relatively non-oxidizing conditions that may cause a meltdown C level depending upon the proportions of individual sources, and an attempt to decarbonize the meltdown charge by oxygen blowing often causes a problem such as splashing. Therefore, the electric furnace cannot be used with advantage when VOD wherein high chromium crude melt of relatively low carbon level is required, is used as secondary decarburization method.

In a converter that performs oxidative refining, the heat of oxidation that is generated by the reaction of blown oxygen with added ferrosilicon or Al can be used to increase the amount of solid ratio, but the ferrosilicon or Al itself is also in an expensive form that has been obtained by using electricity, and furthermore, a large amount of slag formed can pose a problem in the refining operation and can reduce the chromium yield.

The heat generated upon combustion of fuels may be used as an energy source for melting because this provides cheap energy for a given amount of heat generated. But then, the great possibility of reoxidation of metal components makes it difficult to achieve heating at high heat efficiency.

(3) The chromium yield must be high and at the same time the refractory load must be small. The amount of chromium oxidized during decarbonization of high chromium melt depends on the Cr level, C level and temperature of the melt, and the higher the temperature, the easier the control of the chromium oxidation. The refractory load in the reaction vessel is affected by the temperature of the melt and the composition of the slag, and low temperature is desired for minimum refractory load. To compromise the apparently incompatible requirements of the preferential decarbonization and refractory load, it is very important to select the proper operating conditions with respect to the behavior of the temperature and composition of the melt during the refining process.

According to our invention, a process for producing high chromium steel is provided which comprises supplying molten iron into a smelting furnace with a solid chromium source, carbonaceous powder and oxygen-containing gas in amounts so controlled as to keep the melt at a temperature in the range of less than 1650° C. and above the minimum melt temperature that corresponds to the carbon and chromium levels in the melt and which is capable of performing preferential decarbonization while inhibiting the oxidation of chromium.

This invention is now described in detail in the following by reference to the accompanying drawings. One embodiment of the apparatus used in the practice of this invention is shown in side cross section in FIG. 1. The apparatus comprises a converter shaped, refractory lined reaction vessel 1 and basal tuyeres 2 through which to supply oxygen-containing gas and a carbonaceous material like coke powder. The mouth of the vessel 1 is provided with a vertically slidable, oxygen blowing lance 3 and is connected to a rotary kiln 4 which is further connected to a container 5 filled with the charge 6. The first reason for supplying the melt with a carbonaceous material such as coke powder is to recarburize the melt so that it satisfies the component requirements defined below, and the second reason is to supply additional heat for melting that is required according to the amounts of the solid materials added to the melt. As the additional heat for melting, the heat of reaction represented by the scheme $$[C]+[O](\text{or } \tfrac{1}{2}O_2)\rightarrow CO. \quad (7)$$

is used. To supply the melt with a liquid or gaseous carbonaceous material such as oil or hydrocarbon gas does not achieve the purpose of this invention because it absorbs a large amount of heat upon decomposition. Therefore, in this invention, solid carbonaceous materials such as coke powder, coal powder and graphite powder (for example, kish graphite) are used. In this invention, an oxygen-containing gas is also supplied to the melt. The first reason is to provide the melt with the heat of reaction of the scheme (7), and the second reason is to decarbonize the melt so that it satisfies the component requirements specified below. Due to the absorption of heat that occurs when the carbonacoues material is taken into solution by the melt, the area around each tuyere is easily cooled to cause tuyere blockage, so another reason for blowing an oxygen-containing gas into the melt is to prevent this problem by initiating an exothermic reaction in the lower part of the melt. To achieve this purpose, the oxygen supply rate $v_{o2}$ (kg/min) and the carbon supply rate $v_c$ (kg/min) (the supply rate of carbonaceous material being expressed in terms of the supply rate of pure carbon) must satisfy the following relation:

$$v_{o2} \geqq 0.3\ v_c \quad (8)$$

Still another reason for the bottom blowing of oxygen is to generate carbon monoxide gas that can provide a means for agitating the melt that is necessary for preferential decarbonization of the high chromium melt. To achieve this, $(28/16)v_{o2}$ (kg/min) which is an approximation of the level of CO evolved in the melt, and the amount of that melt $G_M$ (t), desirably satisfy the following relation:

$$(28/16)v_{o2} \geqq 120G_M \quad (9)$$

But if an excessive amount of CO gas is evolved, it is just wasted and does not effectively increase the force of agitation. The excessive CO gas also unstabilizes the composition of the melt and can be a cause of low yield of the desired product. It is therefore desired that the relation represented by $$(28/16)v_{o2} \leqq 900G_M \ldots \quad (10)$$

also be satisfied.

Figure 2:
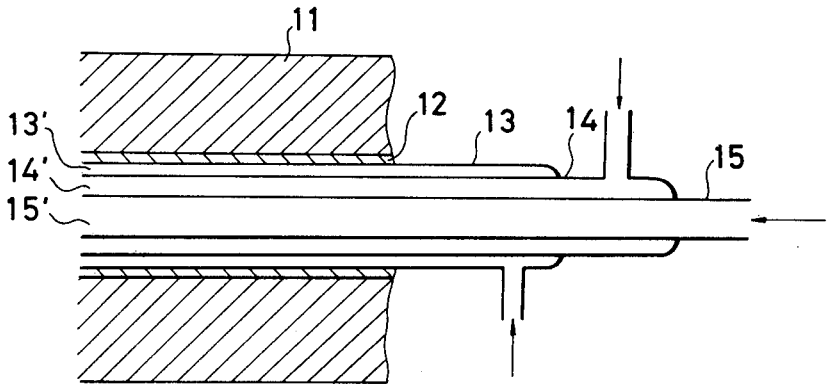
FIG. 2 is a schematic representation of one embodiment of the tuyere to be installed in the reaction vessel.

To achieve these purposes, the carbonaceous material and oxygen-containing gas are supplied to the melt through a tuyere of triple concentric tube type shown in FIG. 2 which includes an inner tube 15, an intermediate tube 14 and an outer tube 13. The gap between the outer tube 13 and the brick 11 is filled with a refractory layer 12. And inert gas (e.g. $N_2$, Ar, CO or $CO_2$ or a mixture thereof) that carries the solid carbonaceous material is fed through the inner tube 15. For achieving stable, continued supply to the melt, the particle size of the carbonaceous material is desirable such that at least 80% of its total weight is made up of a size less than a third of the inside diameter of the inner tube. If the I.D. of the inner tube is 10 mm, the minus mesh of coke powder as produced in a commercial coke plant can be used as a carbonaceous material. If the carbonaceous material is supplied through an outer annular tube 14' rather than through the inner tube 15, stable supply can be achieved only by a powder having a very small particle size (e.g. less than 0.1 mmϕ) which is difficult to prepare and handle. The carbonaceous material may be supplied as a mixture with a flux composed of limy powder (in particular, quick lime). This achieves the following advantages:

(1) Coke powder and other carbonaceous material supplied alone can cause inner tube wear due to friction. Such wear can be greatly reduced by using a mixture of carbonaceous material and limy powder (in particular, quick lime) because the fine particles of the mixture form a coating on the wall of the inner tube. An alternative method of minimizing the wear of the tube wall comprises replacing at least 2% of the carbon content of coke powder with fine particulate carbon or kish graphite. By supplying these materials together with the carbonaceous material, the wear of the tube wall can be reduced by 20 to 95%.

(2) Coke contains gangue that mainly is composed of $SiO_2$, and rapid progress of its melting and slag formation is important for the progress of a slag-metal reaction such as desulfurization. Conditions advantageous for the progress of slag formation are provided by supplying coke and lime through the same tube.

(3) Desulfurization proceeds rapidly.

Through the intermediate annular tube 14', oxygen or an oxidizing gas composed of oxygen and another gas to provide a desired oxygen potential is supplied to the melt to achieve oxidative reactions (decarburization and desiliconization) in the melt to thereby achieve efficient heat generation. After completion of these oxidative reactions, a non-oxidizing gas such as $N_2$ or Ar is supplied through the annular intermediate tube 14'. The supply of oxidizing gas through the annular tube 14' has the following advantages over the supply through the inner tube 15;

(a) The oxidizing gas contacts the molten iron over a wide area to prevent excessive oxidation of the melt.

(b) The life of the oxygen supply tuyere is extended because it is cooled both by the protective cooling gas supplied through the outer tube as described hereunder and by the carbonaceous powder and carrier gas supplied through the inner tube.

(c) When the oxidizing gas is jetted at a fast rate through the annular space between the inner and intermediate tubes, the pressure in the inner tube is reduced to make it easier to supply the carbonaceous powder through the inner tube, and this then reduces the amount of the carrier gas required. As another advantage, no blockage of the inner tube occurs even if the supply of the carrier gas is interrupted temporarily after the stop of the powder supply.

(d) Since the carbonaceous powder supplied through the inner tube is shrouded by a jacket of the oxidizing gas, its temperature increases rapidly and it is easily taken into solution by the melt upon contact therewith. Accordingly, wasteful blowing of the carbonaceous powder will seldom occur even if the bath is not adequately deep.

Through an annular gap 13' between the outer tube 13 and the intermediate tube 14, a protective gas (e.g. a hydrocarbon gas such as propane, oil mist, or an inert gas such as Ar or $N_2$) is supplied for minimum wear and oxidation of the material of which the tuyere is made.

According to one feature of this invention, an additional supply of the heat necessary for melting a solid material such as high carbon ferrochrome is provided by combusting the carbonaceous material added to the melt. This unavoidably increases the amount of required decarbonization, or the amount of oxygen supply. But if the reaction can last for only a limited period of time, it sometimes occurs that not all the supply of oxygen required can be bottom-blown because of the limitation imposed by the formula (10). If this occurs, the remaining part of the oxygen may be injected onto the surface of the melt through the top blowing lance 3 shown in FIG. 1.

The solid carbonaceous material may be supplied from above the furnace instead of from below, and in such top blowing, the following considerations are necessary in order to increase the efficiency of heating of the melt with carbon:

(1) For enhanced agitation of the melt, at least a gas (i.e. $N_2$, Ar or $O_2$-containing gas) is blown from below the furnace;

(2) A solid carbonaceous material composed of particles having a size larger than 10 mm may be simply supplied from above the furnace, but a carbonaceous material composed of particles smaller than 10 mm in size is blown into the melt or slag through a submerged lance. The carbonaceous material supplied into the melt achieves results that are substantially equal to those obtained by supplying it from below. The submerged lance may be composed of an tube having a refractory-coated tip. An inert gas such as $N_2$ or Ar is desirably used as the carrier gas. The carbonaceous material supplied into the slag can reduce the iron and chromium oxides in the slag, and the carbon utilization achieved is as much as 30 to 70% of that achieved when the carbonaceous material is supplied from below the furnace.

Since it is one characteristic feature of this invention to supply the molten iron with a large quantity of solid material which is taken into solution by the melt, the reaction vessel must be such that stable refining with oxygen is achieved irrespective of the change in the amount of the molten iron. In other words, refining must be performed whether the vessel contains a small amount of the melt in the initial stage or a predetermined amount of melt is contained in the final stage. As a result of various studies on the shape of the furnace that satisfies this requirement, it has been found that the desired furnace meets the following requirements:

$$\left.\begin{aligned} S_1 \geqq S_2 \geqq 1.2\frac{Wi}{Wf}S_1 \\ 1.2\frac{Wi}{Wf}S_1 \geqq S_3 \geqq 0.8\frac{Wi}{Wf}S_1 \end{aligned}\right\} \quad (11)$$

wherein $S_1$ ($m^2$) is the average cross-sectional area of the topmost part (H/3) of the final melt whose height is H (m) in terms of the still melt level, $S_2$ ($m^2$) is the average cross-sectional area of the middle part (H/3), $S_3$ ($m^2$) is the average cross-sectional area of the lowest part (H/3), Wi (ton) is the quantity of the initial melt, and Wf (ton) is the predetermined quantity of the final melt. If $S_2$ and $S_3$ are smaller than defined in the formula (11), wear of the refractory increases and in particular, reduced melt yield easily occurs in the final stage of the refining process. If $S_2$ and $S_3$ are larger than defined by the formula (11), low heat efficiency results because refining with oxygen is unstable in the initial stage and the carbonaceous material blown is not satisfactorily taken into solution by the melt. One example of the shape of the furnace that satisfies the requirements specified by the formula (11) is illustrated in FIG. 1 (at the reference numeral 1) or FIG. 5.

For melting larger amounts of solid materials, it is desired that the charge be preheated. In the refining process of the invention wherein a carbonaceous material is supplied, a corresponding increase in the amount of CO gas results as compared with the conventional oxidative refining, so it advantageous to use the resulting sensible heat and latent heat of waste gas for preheating the charge. Both the container 5 and rotary kiln 4 in FIG. 1 are used for preheating the charge 6. Through these preheating units, suitably sized ferroalloy and scrap can be supplied to the melt in the reaction vessel at a desired time. Scrap having a special form that can not be passed through the preheaters can be fed to the reaction vessel batchwise with or without preheating in an external device.

The operating procedure of the apparatus shown in FIG. 1 is described hereunder. The reaction vessel is fed with seed melt, or an iron source in a molten state such as molten iron or steel that is transferred from another furnace. Alternatively, part of the melt is retained in the vessel from a previous refining operation. Since this invention contemplates the case which requires heat generated by oxidation of a carbonaceous material, the amount of the seed melt initially charged is less than 83% of the amount of the final melt. The so prepared seed melt is supplied through basal tuyeres with a solid carbonaceous material, an oxygen-containing gas and a coolant to increase the temperature of the melt, while at the same time, a preheated solid material (e.g. ferroalloy and scrap) is charged from above the vessel so that it is taken into solution by the heated melt. It is the primary purpose of the invention to "increase the chromium yield and reduce the refractory load" by selecting the proper operating conditions when melting and decarbonization are performed at the same time.

Figure 3:
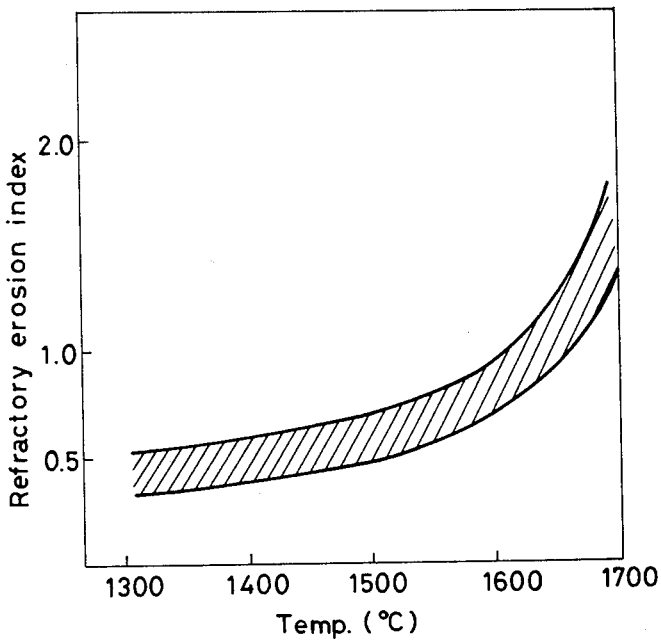
FIG. 3 is a diagram showing the effect of the melt temperature on the refractory wear.

FIG. 3 depicts the effect of the melt temperature on the refractory erosion index. The refractory erosion suddenly increases when the melt temperature exceeds 1650° C. So for the purpose of this invention, it is required that the melt temperature be held at no higher than 1650° C. during the refining process.

$$\text{Melt temp. (°C.)} \leqq 1650 \quad (1)$$

A temperature lower than 1580° C. is particularly preferred according to FIG. 3. The requirement specified by the formula (1) is lower than that defined for conventional techniques for achieving preferential decarbonization of high chromium melt by blowing oxygen. To achieve preferential decarbonization economically while inhibiting the oxidation of chromium under this temperature requirement, the invention selects and observes strict operating conditions (on the combination of temperature and C and Cr levels, in particular).

The requirement for achieving decarbonization while inhibiting the oxidation of chromium at an adequately low oxygen supply rate is represented by the formula (2):

$$\text{Melt temp. (°C.)} \geqq 17.5([Cr]/[C]) + 1200 \quad (2)$$

In this invention, a carrier gas for the carbonaceous material and a hydrocarbon gas for tuyere cooling are supplied through basal tuyeres, and as a result, the partial pressure of CO in bubbles formed in the melt is reduced. To obtain the formula (2), there was conducted an experiment on the equilibrium between [Cr], [C] and temperature for Cr: 0–65%, Pco: 1 atm. and the activity of $Cr_2O_3$ in slag: 1 by taking into account the effect of the reduced partial pressure of carbon monoxide ($P_{co}$) that unavoidably accompanies the supply of the carrier gas and hydrocarbon gas. Needless to say, further decarbonization can be achieved by supplying more diluting gas, but such intentional reduction in Pco is not an economical practice.

The two requirements for the dynamics of decarbonization that predominate over the chromium oxidation are represented by the following formulae (3) and (4):

$$\text{Melt temp. (°C.)} \geqq -140[C(\%)] + 1650 \quad (3)$$

$$\text{Melt temp. (°C.)} \geqq 110[C\%] + 1050 \quad (4)$$

In the refining of high chromium melt by oxygen blowing, a chromium oxide ($Cr_2O_3$) is formed first, which is then reduced with [C] in the melt by the reaction of the following formula:

$$(Cr_2O_3) + 3[C] \rightarrow 2Cr + 3CO \quad (12)$$

The rate of the formation of $Cr_2O_3$ is determined by the oxygen supply rate almost directly, and the upper limit of the rate of reaction of formula (12) is determined by such factors as the composition, temperature and the agitating conditions of the melt. If the rate of reduction of $Cr_2O_3$ is lower than its oxidation rate, $Cr_2O_3$ buildup in the slag causes increased chromium loss and makes stable refining impossible due to undesired slag properties (e.g. high viscosity). If refining is performed at a low $Cr_2O_3$ reduction rate, oxygen must be blown at a slow rate to achieve decarbonization that predominates over the oxidation of chromium, and this is not desired because the productivity of the refining apparatus is decreased. Therefore studies have been made on the requirements for Cr and C levels and temperature that increase the rate of reduction of $Cr_2O_3$ according to the formula (12) and it has been found that the carbon level affects the $Cr_2O_3$ reduction rate most. If the formula (3) is not satisfied, the activity of [C] is too small and the viscosity of the melt is high so the rate of the reaction of formula (12) suddenly decreases. The requirement that must be met to prevent this is represented by the formula (3), more preferably by the formula (13):

$$\text{Melt temp. (°C.)} \geqq -140[C(\%)] + 1710 \quad (13)$$

If the formula (4) is not met, the fluidity of the melt also becomes low and the rate of the reaction of formula (12) decreases again suddenly. It has been confirmed experimentally that the carbon level that causes this sudden reduction depends little on the chromium level. The rate of the reaction of the formula (12) is in proportion to the rate at which CO gas evolves, and the rate at which CO gas evolves is proportional to the oxygen blowing rate under conditions favorable to the smooth progress of decarbonization.

As described in the foregoing, the invention successfully achieves decarbonization at low temperatures while inhibiting the oxidation of chromium by performing steady refining operation (in terms of temperature and C and Cr levels) within a medium carbon range that has so far attracted little attention in the prior art techniques.

One example of the method to meet the requirements defined by the formulae (1), (2), (3) and (4) is described below. First, measurement of the temperature of the melt as well as the sampling and analysis of the melt are made at adequate intervals. If the temperature of the melt begins to exceed the upper limit, the oxygen supply is reduced or the supply rate of the solid material (i.e. high carbon ferrochrome) is increased. If the temperature of the melt begins to fall beyond the lower limit, the oxygen supply is increased or the supply rate of solid material is decreased. The chromium level (%) is determined almost directly by the amount of chromium supplied to the reaction vessel. If the carbon level (%) begins to exceed the upper limit, either the oxygen supply is increased or the supply of the carbonaceous material is decreased, and if the carbon level begins to drop beyond the lower limit, either the oxygen supply is reduced or the supply of the carbonaceous material is increased. It is to be noted that for maintaining the proper conditions for Cr and C levels and temperature, the substance supplied to the reaction vessel must react (for dissolution in the melt or chemical reaction) with the melt at a rate sufficiently fast to achieve quick response of temperature and Cr and C levels upon adjustment of the supply of that material. The reaction between the carbonaceous material and the melt as well as the reaction between oxygen and the melt take place very fast and achieve reasonably quick response if the requirements specified before are met. But if ferrochrome is supplied to the reaction vessel under improper conditions, a long time is required to dissolve it in the melt and the response to the adjustment of temperature and Cr and C levels is so slow that it is difficult to meet the requirements specified by the formulae (1), (2), (3) and (4). Therefore experimental studies have been made to determine the effect of various factors on the dissolution rate of high carbon ferrochrome. As a result, it was found that the dissolution rate v (mm/sec) is represented by the following formula (14):

$$\log v = -(15{,}673/T) + 8.36 + \log 8.3 - ([C(\%)]/4.0) \quad (14)$$

wherein T(°K.) is the temperature of the melt. The conventional high carbon ferrochrome comprises lumps each having a side shorter than 200 mm, so in order to dissolve them in the melt within a period of 5 minutes that is considered a quick response time in the actual control process, the dissolution rate v must be larger than 0.33 mm/sec, or the following relation (5) must be satisfied;

$$\text{Melt temp. (°C.)} \geqq -273 + \frac{15673}{8.84 + \log \frac{8.3 - [C(\%)]}{4.0}}$$

Since stainless steel scrap comprises generally thin pieces, they are taken into solution by the melt fast enough to have no great adverse effect on the adjustability of temperature and Cr and C levels.

If refining is performing by supplying the reaction vessel with oxygen and solid material at rates to maintain the temperature and Cr and C requirements that satisfy the formulae (1) to (5), the refractory load is reduced, the oxidation of chromium is inhibited, and at the same time, the melting of high carbon ferrochrome and scrap can be achieved stably in terms of both equilibrium and dynamics.

Figure 4:
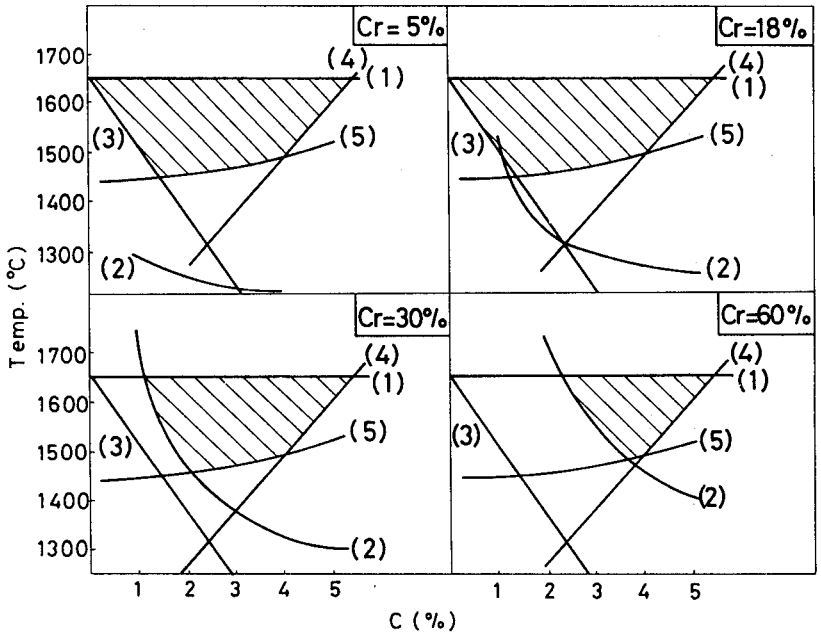
FIG. 4 shows diagrams that illustrate the optimum operating conditions (hatched portion) for the invention in terms of the carbon level (%) versus melt temperature relation for chromium levels of 5%, 18%, 30% and 60% which are defined by the formulae (2), (3), (4) and (5).

FIG. 4 includes charts that show the relation of carbon level (%) and the melt temperature that satisfies the formulae (1) to (5) for chromium levels of 5%, 18%, 30% and 60%.

By the method described above, the solid material can be taken into solution by the melt to provide high chromium crude melt most economically. If that melt contains more chromium than desired for the final product, it may be mixed with, for example, low carbon molten steel before it is sent to the secondary refining step. If the melt contains more carbon than the carbon level required by the secondary refining furnace, the supply of the carbonaceous material may be stopped after the solid material has been taken into solution by the melt, and oxygen is blown into the melt together with a diluting gas in an amount determined by the desired carbon level.

In this invention, if coke powder or coal powder containing a fairly large amount of silicon and phosphor as impurities is used as the carbonaceous material, a melt having high sulphur and phosphor levels is produced. If only sulphur need be removed, slag having a $CaO/SiO_2$ ratio of 1.2 to 2.0 is formed in the reaction vessel after completion of oxygen supply, and ferrosilicon is added to the melt which is then agitated by blowing a gas into it. If phosphor need also be removed, a special dephosphorization technique is necessary because melt containing chromium cannot be dephosphorized by basic oxidizing slag that is conventionally used in dephosphorization of molten iron or steel. The special technique comprises reacting the decarbonized melt with a $CaC_2$-$CaF_2$ flux. The decarbonized melt is unsaturated with carbon, so upon addition of $CaC_2$-$CaF_2$, Ca is liberated to start dephosphorization as well as desulphurization. The use of a $CaC_2$-$CaF_2$ flux is also accompanied by recarburization (C:0.1-0.3%), but this causes no problem because the so treated melt is then subjected to secondary decarbonization. Any impurities can be removed by the methods described above, so the refining process contemplated by the invention makes it possible to choose the most inexpensive carbonaceous material without considering the amount of impurities.

The process of the invention may be used to produce medium carbon, high chromium melt as an intermediate for the manufacture of nickel-containing austenite stainless steel, and if NiO is used as a nickel source, the most effective method is to mix NiO powder with a carbonaceous powder such as coke powder in an amount of 15 to 180% of the equivalent amount for reduction according to $NiO+C \rightleftarrows Ni+CO$, form the mixture into briquettes, supply them to preheating units (i.e. the rotary kiln 4 and container 5 of FIG. 1) for preheating and reduction of nickel oxide (NiO). If the amount of carbonaceous powder mixed with NiO powder is less than 15% of the equivalent amount for reduction, only low reduction efficiency is achieved because of reoxidation, and if the amount of carbonaceous powder exceeds 180% only weak briquettes are formed and Ni scatters easily. The optimum amount of carbonaceous powder to be mixed with NiO powder is from 30 to 70% of the equivalent amount for reduction. In the most desirable method, an iron pipe filled with a mixture of NiO and coke powder is cut into suitable sizes or a mixture enclosed with an iron sheet is formed into a suitable shape. By this method, a preliminary reduction efficiency of 98% or more and a nickel yield in the melt of 99% or more can be achieved. The advantages of using NiO this way as a nickel source includes the following:

(i) More melt can be used as an iron source than when ferronickel is used, so the feature of the process contemplated by the invention (use of melt as an iron source) is easily obtained:

(ii) The Ni cost is lower than metallic nickel.

Therefore, nickel-containing medium carbon, high chromium melt (as an intermediate for the manufacture of austenite stainless steel) can be produced economically by the method of the invention.

Another material that can be used in the production of nickel-containing medium carbon, high chromium melt is a powder wherein ferronickel is combined with a solid carbonaceous material. The powder is prepared in the following manner: nickel ore, coke (or anthracite), and a chloride are heated to a temperature higher than 900° C. to liberate nickel in the form of a chloride which is then reduced with coke powder to form ferronickel (containing more nickel than ordinary ferronickel (140 to 50%)) deposited on the surface coke particles. To provide ferronickel of the grade use in the conventional steel-making step, the so prepared ferronickel combined with solid carbonaceous material must be treated by cooling, magnetic separation and melting. But in the process of the invention, such intermediate product (C:2-30%) wherein ferronickel is combined with solid carbonaceous material can be used effectively by blowing the powder of the product into the melt from below as part of the solid carbonaceous material or by supplying briquettes of the product from above the furnace. The latter method is effective for achieving high heating efficiency due to efficient contact with the melt because the combination of ferronickel and solid carbonaceous material has a greater specific gravity than the conventional solid carbonaceous material.

Partially reduced chrome pellet that is produced as an intermediate in the manufacture of high carbon ferrochrome and which contains $Cr_2O_3$ may be used as part of the chromium source. This is prepared by heating pellets or briquettes of a mixture of chromite and carbonaceous material such as coke powder to a temperature higher than 1400° C. The typical composition of these chrome pellets or briquettes is as follows: T.Cr 34.1%, Cr reduction ratio 50% (wherein Cr reduction ratio means the ratio of metallic chromium to metallic chromium plus chromium oxide), T.Fe 14.8%, Fe reduction ratio 95%, $SiO_2$ 8%, MgO 14% and $Al_2O_3$ 12%. Such chrome pellets or briquettes can be used as part of the chromium source (preferably in an amount of 10 to 30% of the chromium source). If the amount of these chrome pellets or briquettes exceeds 30%, the amount of chromium that is to be reduced in the reaction vessel increases and the productivity is decreased, and in addition, the gangue in the pellets or briquettes forms increased amount of slag. If they are used in an amount of 10 to 30%, MgO in the gangue helps reduce the refractory wear and $Al_2O_3$ in the gangue increases the slag fluidity to thereby decrease the Cr level in the slag.

The process contemplated by the invention achieves economical production of stainless steel at a steel plant which manufacture not only stainless steel but also plain carbon steel. The process uses cheap molten iron as an iron source and dissolves a solid material in the melt by means of heat generated not by electricity but by inexpensive primary energy. Selecting unconventional conditions that achieve stable melting and decarbonization under low temperature within a medium carbon, high chromium range, the process of the invention permits drastic cost reduction and stable refining operation and is expected to make a great contribution to the steelmaking industry.

The process of the invention is now described in greater detail by reference to the following examples which are given here for illustrative purposes only and are by no means intended to limit the scope of the invention.

EXAMPLE 1

Figure 5:
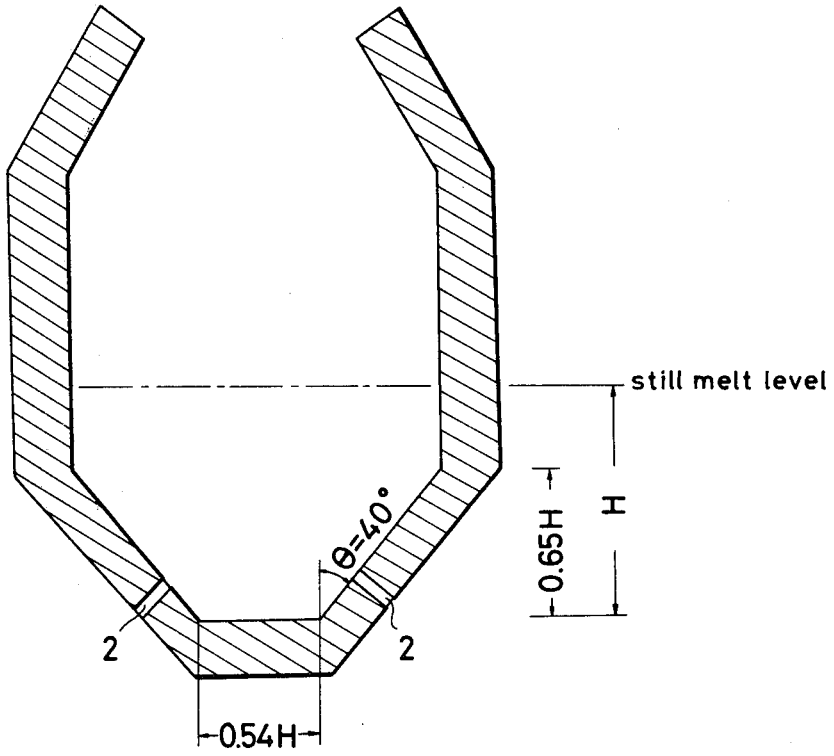
FIG. 5 is a schematic representation of a side cross-section of the converter-shaped vessel used in the practice of the invention.

A reaction vessel of the shape illustrated in FIG. 5 was used. The amount of the final melt was about 50 tons. The vessel had five tuyeres of triple concentric tube type in the lower part of the vessel.

| | I.D. | O.D. |
|---|---|---|
| Inner tube (stainless steel) | 6 mmϕ | 9 mmϕ |
| Intermediate tube (stainless steel) | 12 mmϕ | 14 mmϕ |
| Outer tube (copper, for supply of 50 $Nm^3$/hr of propane) | 15 mmϕ | 17 mmϕ |

The vessel contained 15 tons of molten iron that was retained from a previous refining operation (Cr 40%, C3%, temp. 1570° C.). Into the melt, coke powder was blown through the inner tube as it was carried by nitrogen that was supplied at a constant rate of 30 $Nm^3$/hr.

| Coke composition | | |
|---|---|---|
| C (%) | $SiO_2$ (%) | $Al_2O_3$ (%) |
| 89.0 | 5.5 | 2.5 |

| Coke particle size (wt %) | | | | |
|---|---|---|---|---|
| +0.5 mm | 0.5–0.25 mm | 0.25–0.15 mm | 0.15–0.06 mm | −0.06 mm |
| 3.6 | 9.2 | 30.0 | 20.4 | balance |

Figure 6:
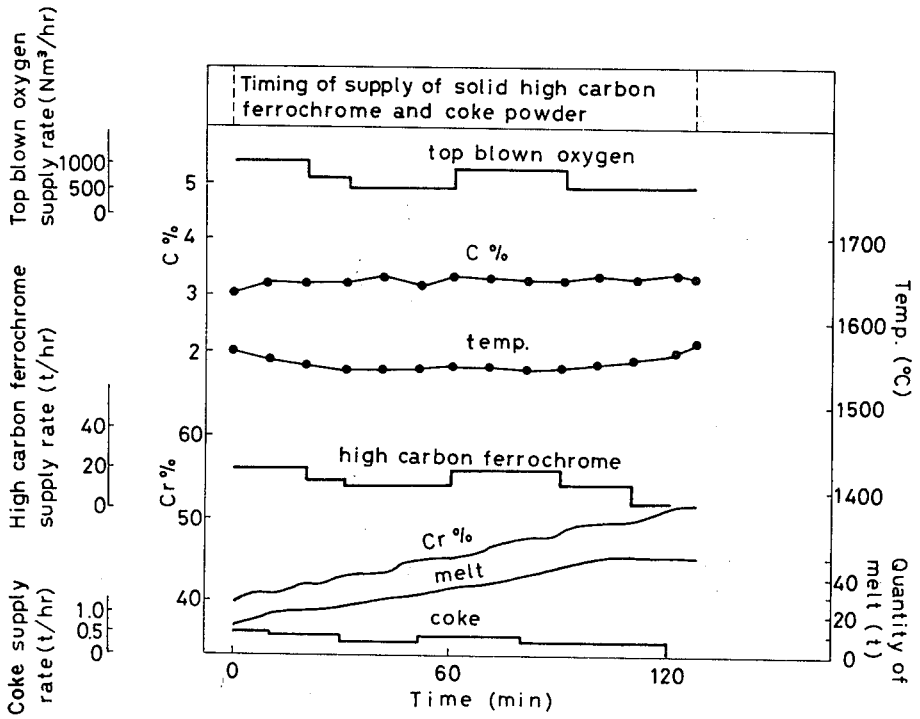
FIGS. 6 to 9 are diagrams that depict the behavior of carbon and chromium levels and temperature, the change in supply of top blown oxygen, the change in tonnage of molten steel following the charge of high carbon ferrochrome, and the change in supply of coke in the dissolution of high carbon ferrochrome according to Examples 1, 2, 3 and 4, respectively.

The supply of coke was varied according to the state of the furnace as shown in FIG. 6. Oxygen was blown through the intermediate tube at a constant rate of 800 $Nm^3$/hr. It was also supplied through a top blowing lance at a rate that varied between 0 to 1000 $Nm^3$/hr depending upon the state of the furnace as shown in FIG. 6. Preheated high carbon ferrochrome particles (10 to 50 mm in size) were supplied from above the furnace through a rotary kiln. By changing the rotating speed of the rotary kiln from 2 to 6 rpm, the amount of high carbon ferrochrome supplied to the furnace was varied (see FIG. 6).

| Composition of high carbon ferrochrome (wt %) | | | | |
|---|---|---|---|---|
| Cr | Si | C | P | S |
| 55.0% | 2.5% | 8.0% | 0.033% | 0.03% |

(ave. preheating temp.: 800° C.)
(ave. supply rate: 17 t/hr)

Quick lime was supplied from above the furnace in eight 300 kg portions at intervals of 15 minutes.

The temperature of the melt was measured with a sensor lance at intervals of 10 minutes. The chromium level was calculated from the mass balance of the substances that had been supplied to the furnace. The carbon level could also be determined by analysis of samples taken at intervals of 10 minutes. The temperature of the melt was maintained between 1550° and 1580° C. To do this, the supply rate of high carbon ferrochrome and top blown oxygen was decreased when the temperature of the melt began to increase, and it was adjusted the other way when the melt temperature began to decrease. The carbon level was maintained between 3.0 and 3.3%. To achieve this purpose, more carbon was blown into the melt when the carbon level analyzed was found to decrease, and less carbon was blown when the carbon level was found to increase. By following these procedures for 130 minutes, 36 tons of high carbon ferrochrome was taken into solution by the melt, and medium carbon, high chrome molten iron (Cr 51%, C 3.1%, 1580° C.) was produced.

Then, the top blowing of oxygen was stopped and argon rather than oxygen was supplied from below. Following addition of 250 kg of ferrosilicon, the melt was agitated for 5 minutes and mixed in a ladle with 110 tons of low carbon molten steel (C 0.03%, Si 0.2%, 1650° C.) produced in a converter and a melt containing 16.5% Cr and 0.97% C resulted. The melt was then refined by blowing oxygen to provide molten stainless steel containing 16.2% Cr and 0.05% C by oxygen blowing under vacuum.

The composition of slag (after reduction) was as follows.

| CaO | $SiO_2$ | MgO | T.Cr | T.Fe | S |
|---|---|---|---|---|---|
| 49.3% | 43.4% | 5.2% | 0.9% | 0.2% | 0.8% |

EXAMPLE 2

Medium carbon, high chromium steel was produced using the same reaction vessel, basal tuyeres, residual melt, coke powder grade and high carbon ferrochrome grade as used in Example 1. In addition to the high carbon ferrochrome, partially reduced chromium pellets (as defined hereinabove) were used as a part of the chromium source.

| | |
|---|---|
| Oxygen | Bottom blowing: 1500 $Nm^3$/hr (const.)<br>Top blowing: 500 to 2000 $Nm^3$/hr (see FIG. 7) |
| Chromium source | High carbon ferrochrome (FIG. 7)<br>Partially reduced chrome pellets: those which were preheated to about 1000° C. by an external heater were supplied from above the furnace at intervals of 10 minutes at a constant rate of 4.1 t/hr. |
| Solid carbonaceous material | Coke powder: bottom blown (FIG. 7)<br>Coke lumps: those having a diameter of 10 to 30 mmϕ and a composition the |

-continued

| | |
|---|---|
| | same as that of coke powder were supplied in 200 kg portions at 10-min intervals simultaneously with the partially reduced chrome pellets. |
| Lime | Lime powder: those having a size less than 1 mm were supplied together with bottom blown coke powder in an amount of 10% of that coke powder. Lime lumps: supplied at 10-min intervals simultaneously with the partially reduced chrome pellets. |

Figure 7:
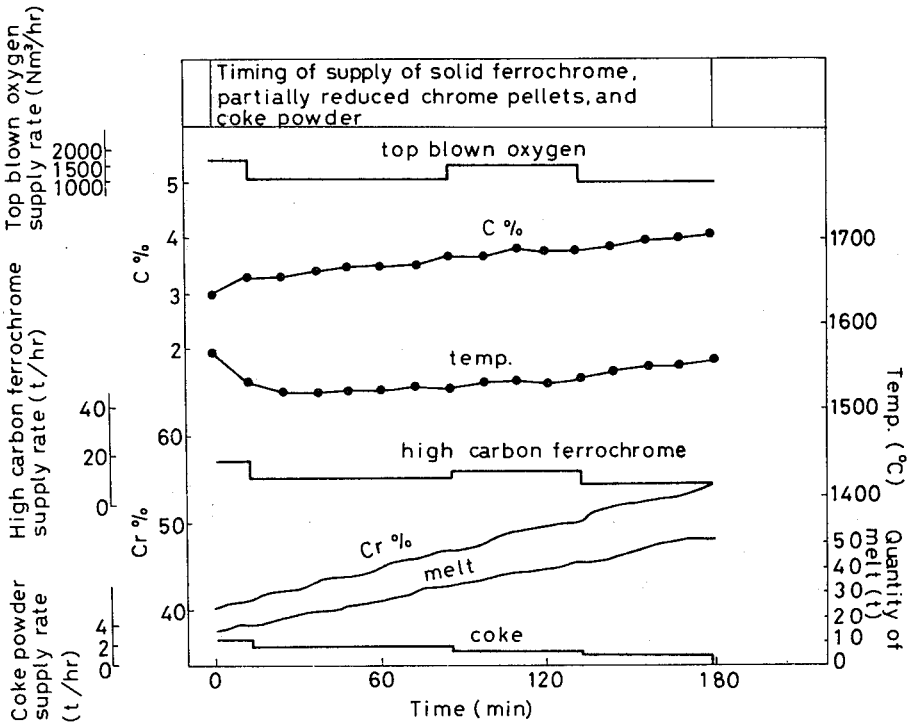

FIG. 7 shows the behavior of the temperature and composition of the melt. The temperature was maintained in the range of from 1510° to 1570° C. The method of controlling the temperature and carbon level was almost the same as used in Example 1. A hundred eighty hours later, 350 kg of Ca-Si was added to provide melt and slag of the following compositions:

| Cr | C | Si | P | S | Temp. |
|---|---|---|---|---|---|
| 52.5% | 4.1% | 0.2% | 0.043% | 0.025% | 1590° C. |

| CaO | $SiO_2$ | $Al_2O_3$ | MgO |
|---|---|---|---|
| 35.2% | 17.6% | 22.6% | 23.8% |

A flux composed of a powdered mixture of $CaC_2$ (500 kg) and $CaF_2$ (65 kg) was added to 50 tons of the melt which was then tapped into a ladle. By fluxing, the phosphor level was decreased from 0.043% to 0.025%, the sulfur level from 0.025% to 0.010%, and the carbon level increased from 4.0% to 4.3%. The melt was combined with low carbon molten steel and transferred to an AOD furnace where it was decarbonized to give molten stainless steel containing 17.2% Cr and 0.05% C.

EXAMPLE 3

A conventional 150-t capacity converter equipped with four basal tuyeres of the same triple concentric tube type as used in Example 1 was employed. The converter was charged with 110 tons of molten iron (C: 3.9%, Si<0.1%, P: 0.010%, temp. 1370° C.) that had been dephosphorized in the ladle. To the melt, oxygen (both top and bottom blown), coke powder (bottom blown), fine particulate carbon (bottom blown), high carbon ferrochrome preheated to 1000° C. (supplied from above) and lime (lumps supplied from above, and powder bottom blown together with coke powder) were added.

| | |
|---|---|
| Oxygen | Bottom blowing: 1500 $Nm^3$/hr (const.) Top blowing: see FIG. 8 |
| Chromium source | High carbon ferrochrome (preheated to 1000° C., supplied from above, see FIG. 8) |
| Solid carbonaceous material | Coke powder: bottom blown (see FIG. 8) Coal powder: 80% C, 7% volatile, 12% ash, mixed with coke powder in an amount of 10% |
| Lime | Lime lumps: supplied from above Lime powder: bottom blown, mixed with coke powder in an amount of 10% |
| Powder carrier gas | $N_2$: 70 $Nm^3$/hr (const.) |

Figure 8:
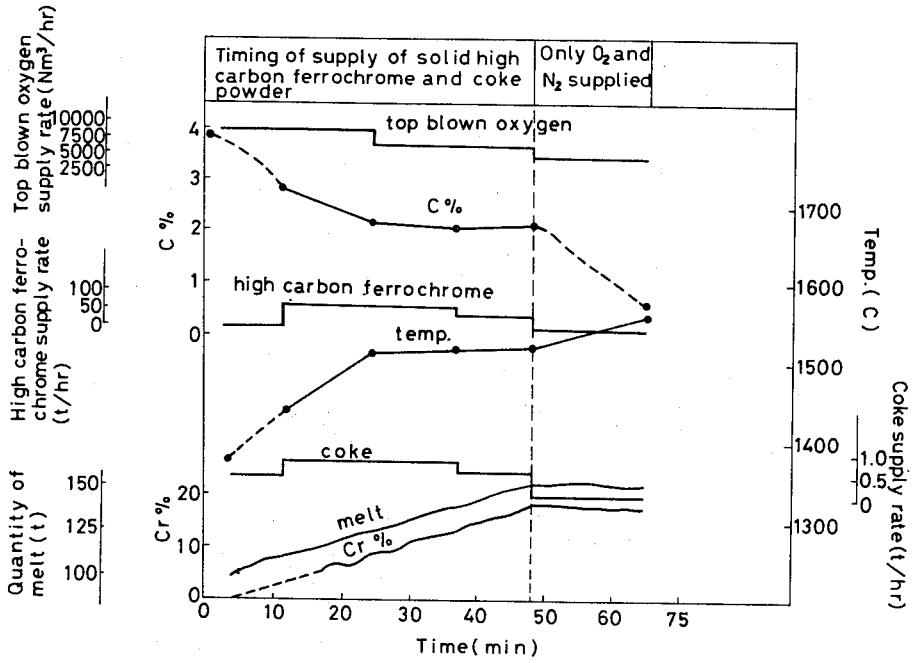

FIG. 8 shows the behavior of the temperature and composition of the melt. The method of controlling the temperature and carbon level was almost the same as used in Example 1. When the addition of solid ferrochrome was completed, the supply of solid carbon source and top blown oxygen was stopped. Then, oxygen and nitrogen gas was bottom-blown for 14 minutes to decarbonize the melt (for the composition and temperature profile of the melt, see FIG. 8). Then, 700 kg of ferrosilicon was added to the melt which was agitated with argon gas. The so treated melt was tapped into a ladle and subjected to secondary decarbonization by the vacuum oxygen blowing method.

EXAMPLE 4

In this example, NiO (77% Ni) was used as a nickel source. Cans (50 mmϕ×50 mm) made of iron sheet (2 mm thick) filled with a mixture of NiO powder (particle size: less than 0.5 mm) and 5 wt% of coke powder (less than 0.2 mmϕ) were pre-reduced by heating with waste offtake gas and supplied to the furnace continuously as well as high carbon ferrochrome. The average reduction ratio of Ni was 78%. All other conditions were substantially the same as in Example 3 except that the high carbon ferrochrome had the following composition.

| Cr | Fe | Si |
|---|---|---|
| 55.2% | 38.0% | 3.3% |

Figure 9:
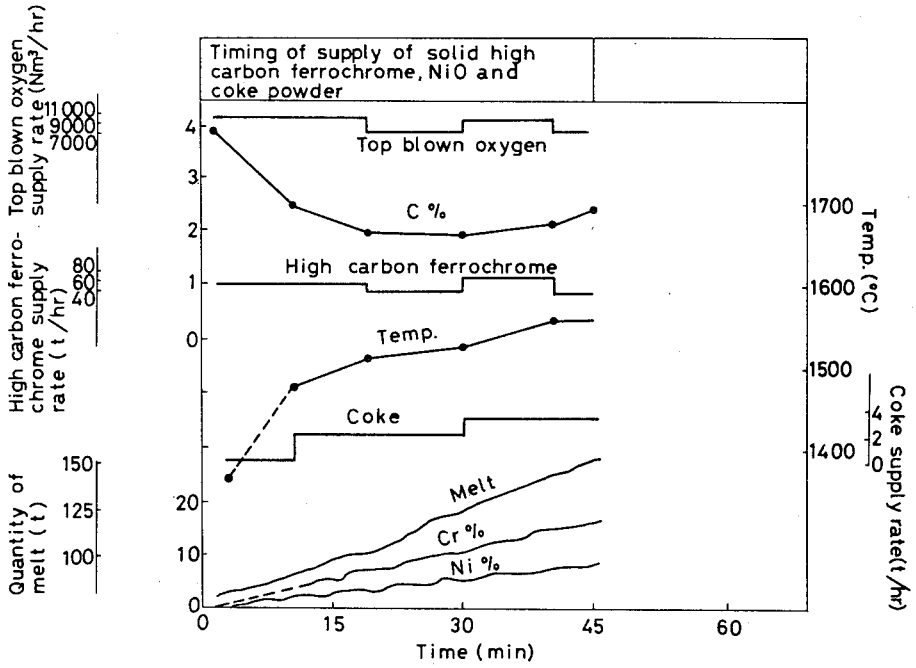
Figure 10:
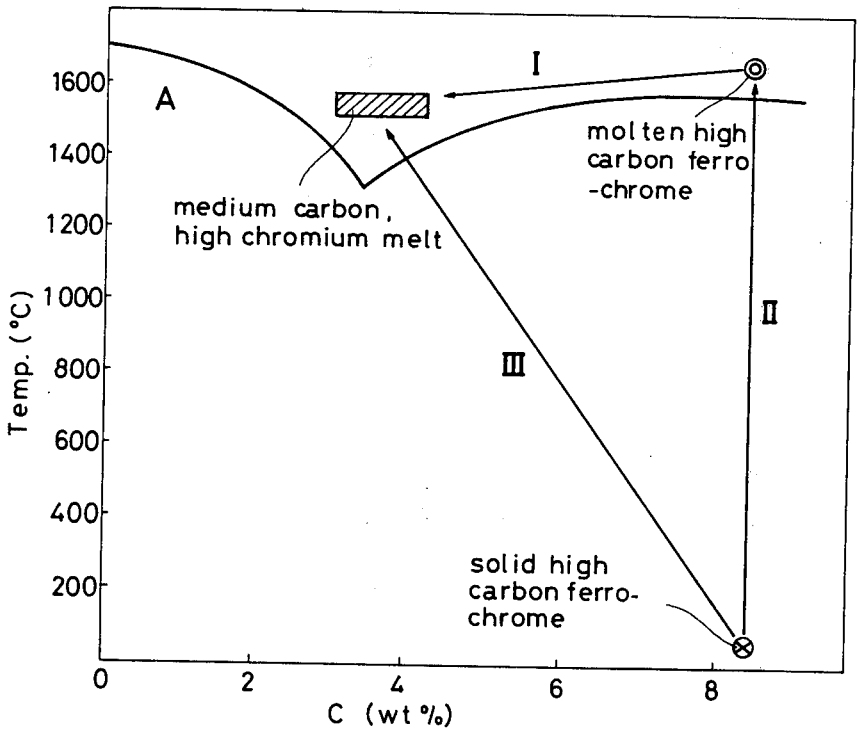
FIG. 10 shows schematically the features of the process by a diagram for the relation between carbon level (wt%) and temperature (°C.) in the melt in a smelting furnace.

FIG. 9 shows the behavior of the composition and temperature of the melt. Nickel-bearing, medium carbon, high chromium molten steel having a Ni yield of 99.7% and the following composition was produced.

| Cr | Fe | Ni | P | S |
|---|---|---|---|---|
| 17.3% | bal. | 8.1% | 0.021% | 0.025% |

This crude steel was refined by AOD.

EXAMPLE 5

Ferronickel combined with coke (as defined hereinabove, this was obtained by heating nickel ore, chloride and anthracite to about 1000° C.) was used as nickel and carbon sources.

| Composition of ferronickel combined with coke | | | | |
|---|---|---|---|---|
| Ni | Fe | C | P | S |
| 49.6% | 44.2% | 5.6% | 0.020% | 0.083% |

The combination was compressed at 15 atm. into briquettes each measuring 25 mmϕ×30 mm, and the briquettes were supplied to the melt from above the furnace in 1100 kg portions at intervals of 2 minutes. All other conditions and the behavior of the temperature and composition of the melt were substantially the same as in Example 4. Nickel-bearing medium carbon, high chromium molten steel having a nickel yield of 99.5% and the following composition was produced.

| Cr | Fe | Ni | P | S |
|---|---|---|---|---|
| 17.6% | bal. | 7.8% | 0.019% | 0.020% |

This crude steel was refined by AOD.

EXAMPLE 6

A reaction vessel of the same type as shown in FIG. 5 was used except that it was equipped with four basal tuyeres of the double concentric tube type specified below.

| | I.D. | O.D. |
|---|---|---|
| Inner tube | 16 mmϕ | 18 mmϕ |
| Outer tube | 19 mmϕ | 21 mmϕ |

Oxygen was supplied through the inner tube at a constant rate of 1500 $Nm^3/hr$ and propane was fed through the outer tube at a constant rate of 50 $Nm^3/hr$. Coke powder was supplied from above the furnace and nitrogen was supplied as a carrier gas through a submerged lance (iron tube having I.D. 25 mm and O.D. 31 mm and $Al_2O_3$ coated tip). All other conditions were the same as in Example 1. By supplying coke powder about 1.7 times as fast as in Example 1, medium carbon, high chromium molten steel showing almost the same behavior of temperature and composition as in Example 1 was obtained.

EXAMPLE 7

A reaction vessel of the same type as used in Example 6 was used and coke lumps (10 to 50 mmϕ) instead of coke powder were supplied as the solid carbonaceous material. The coke lumps were supplied from above the furnace at an interval of about one minute. All other conditions were the same as in Example 1. By supplying the solid carbonaceous material about 2.1 times as fast as in Example 1, medium carbon, high chromium molten steel showing almost the same behavior of temperature and composition was provided.

What is claimed is:

1. A process for producing chromium steel which comprises:

supplying molten iron in a smelting furnace with a solid chromium source, carbonaceous powder and oxygen-containing gas in amounts so controlled as to keep the melt, without using electricity as a heat source, at a temperature in the range of less than 1650° C. and above the minimum melt temperature at the specific carbon and chromium levels in the melt and which is capable of performing preferential decarbonization while inhibiting the oxidation of chromium, said solid chromium source comprising one or more substances selected from the group consisting of high carbon ferrochrome, medium carbon ferrochrome, low carbon ferrochrome, metallic chromium, chrome ore, partially reduced chromium pellets and chromium-bearing scrap, and containing unmelted chromium, to produce a medium carbon, high chromium molten iron containing 4 to 65 wt% of chromium and a Cr/C ratio of from 8 to 30, and refining said medium carbon, high chromium molten iron into chromium steel.

2. A process according to claim 1, wherein the temperature above the minimum melt temperature is defined by the following formulae (2), (3), (4), and (5):

$$\text{Melt temp. (°C.)} \geqq 17.5 \frac{[Cr]}{[C]} + 1200 \quad (2)$$

$$\text{Melt temp. (°C.)} \geqq -140\,[C\,(\%)] + 1650 \quad (3)$$

$$\text{Melt temp. (°C.)} \geqq 110\,[C\,(\%)] + 1050 \quad (4)$$

-continued $$\text{Melt temp. (°C.)} \geqq -273 + \frac{15673}{8.84 + \log \frac{8.3 - [C\,(\%)]}{4.0}} \quad (5)$$

3. A process according to claim 2, wherein the formula (3) is replaced by the formula (13):

$$\text{Melt temp. (°C.)} \geqq -140[C(\%)] + 1710 \quad (13).$$

4. A process according to claim 1, wherein the melt temperature is held below 1580° C.

5. A process according to claim 1, wherein the refining of the melt in a smelting furnace is achieved by dissolving in said melt a carbonaceous powder and oxygen-containing gas supplied through tuyeres located in the lower part of the furnace.

6. A process according to claim 5, wherein said tuyeres are of triple concentric tube type composed of a central passageway through which to blow a carrier gas and a carbonaceous powder, an intermediate annular passageway through which to blow an oxygen-containing gas and an outer annular passageway through which to blow a coolant fluid for the tuyeres.

7. A process according to claim 1, wherein the refining of the melt in a smelting furnace is achieved by dissolving in said melt carbonaceous lumps supplied from above the furnace.

8. A process according to claim 1, wherein the refining of the melt in a smelting furnace is achieved by dissolving in said melt a carbonaceous powder and an oxygen-containing gas supplied through a top blowing lance located on top of the furnace.

9. A process according to claim 1, wherein the solid chromium source is supplied to the melt in a smelting furnace in divided portions.

10. A process according to claim 1, wherein the oxygen-containing gas is supplied through a top blowing lance and tuyeres located in the lower part of the furnace.

11. A process according to claim 1, wherein said carbonaceous powder is partially replaced by a solid carbonaceous powder comprising carbonaceous particles to which metallic nickel adheres.

12. A process according to claim 1, wherein said melt is further supplied with nickel oxide that has been prereduced outside said smelting furnace.

13. A process according to claim 1, wherein the shape of the smelting furnace is such that the following formula (11) is satisfied:

$$\left.\begin{array}{l} S_1 \geqq S_2 \geqq 1.2 \frac{Wi}{Wf} S_1 \\ 1.2 \frac{Wi}{Wf} S_1 \geqq S_3 \geqq 0.8 \frac{Wi}{Wf} S_1 \end{array}\right\} \quad (11)$$

wherein $S_1$ ($m^2$) is the average cross-sectional area of the topmost part (H/3) of the final melt whose height is H(m) in terms of the still melt level, $S_2$ ($m^2$) is the average cross-sectional area of the middle part (H/3), $S_3$ ($m^2$) is the average cross-sectional area of the lowest part (H/3), Wi (ton) is the quantity of the initial melt, and Wf (ton) is the predetermined quantity of the final melt.

14. A process according to claim 1, which further comprises performing decarbonization of the medium carbon, high chromium molten iron.

15. A process according to claim 1, which further comprises controlling the chromium content of the medium carbon, high chromium molten iron by adding thereto molten steel which does not contain chromium, followed by decarbonization of the so controlled melt.

* * * * *